US009649524B2

(12) United States Patent
Giunchi

(10) Patent No.: US 9,649,524 B2
(45) Date of Patent: May 16, 2017

(54) GYMNASTIC MACHINE

(71) Applicant: Marco Giunchi, Cesenatico (IT)

(72) Inventor: Marco Giunchi, Cesenatico (IT)

( * ) Notice: Subject to any disclaimer, the term of this patent is extended or adjusted under 35 U.S.C. 154(b) by 0 days.

(21) Appl. No.: 14/894,481

(22) PCT Filed: May 26, 2014

(86) PCT No.: PCT/IB2014/061721
§ 371 (c)(1),
(2) Date: Nov. 27, 2015

(87) PCT Pub. No.: WO2014/191898
PCT Pub. Date: Dec. 4, 2014

(65) Prior Publication Data

US 2016/0114205 A1 Apr. 28, 2016

(30) Foreign Application Priority Data

May 28, 2013 (IT) ..... MO2013A0152

(51) Int. Cl.
*A63B 21/078* (2006.01)
*A63B 71/00* (2006.01)
(Continued)

(52) U.S. Cl.
CPC ..... *A63B 21/0783* (2015.10); *A63B 21/062* (2013.01); *A63B 21/154* (2013.01);
(Continued)

(58) Field of Classification Search
CPC ..... A63B 21/00069; A63B 21/4047; A63B 2208/0204; A63B 23/12; A63B 2225/09;
(Continued)

(56) References Cited

U.S. PATENT DOCUMENTS 4,195,834 A * 4/1980 Lambert, Jr. ..... A63B 21/06 482/101
4,286,782 A * 9/1981 Fuhrhop ..... A63B 21/078 482/103
(Continued)

FOREIGN PATENT DOCUMENTS

EP 1334750 A1 8/2003
FR 2507903 A2 12/1982

OTHER PUBLICATIONS

Italian Search Report dated Jan. 27, 2014 from Italian Patent Application No. MO2013A000152 filed May 28, 2013.
(Continued)

*Primary Examiner* — Andrew S Lo
(74) *Attorney, Agent, or Firm* — Sunstone IP

(57) ABSTRACT

A gymnastic machine having a frame defining a support area for the back of a user and a platform for the support of the feet, where the support area and the platform are inclined on opposite sides with respect to the vertical and are mutually convergent downwards. A work unit is associated with the frame and has a loading unit for the execution of a gymnastic exercise and movement means for moving the loading unit. The work unit has a bearing element associated with the frame and the movement means has a grip element which can be gripped by the user, the shift of the grip element causing the loading unit to shift. The movement means has at least a pulley placed between the grip element and the loading unit and connected in a kinematic manner to the latter by means of at least a flexible element.

13 Claims, 4 Drawing Sheets

(51) Int. Cl.
*A63B 21/00* (2006.01)
*A63B 23/035* (2006.01)
*A63B 23/12* (2006.01)
*A63B 21/062* (2006.01)

(52) U.S. Cl.
CPC ..... *A63B 21/157* (2013.01); *A63B 21/4031* (2015.10); *A63B 21/4035* (2015.10); *A63B 21/4045* (2015.10); *A63B 23/03525* (2013.01); *A63B 23/1209* (2013.01); *A63B 71/0054* (2013.01); *A63B 21/078* (2013.01); *A63B 2071/0081* (2013.01); *A63B 2208/0204* (2013.01); *A63B 2225/09* (2013.01)

(58) Field of Classification Search
CPC ..... A63B 23/03541; A63B 21/015; A63B 2210/50
USPC ..... 482/127
See application file for complete search history.

(56) References Cited

U.S. PATENT DOCUMENTS 4,316,609 A * 2/1982 Silberman ..... A63B 21/4031 482/102
5,201,694 A * 4/1993 Zappel ..... A63B 21/00072 482/133
5,433,687 A * 7/1995 Hinzman ..... A63B 21/00047 248/580
6,379,287 B1 4/2002 Slawinski et al.
6,685,601 B1 * 2/2004 Knapp ..... A63B 21/078 482/104
7,070,546 B1 * 7/2006 Grasso ..... A63B 21/072 482/103
7,083,554 B1 * 8/2006 Lo Presti ..... A63B 21/155 482/100
D533,910 S * 12/2006 Dibble ..... D21/676
7,482,050 B2 * 1/2009 Olson ..... A63B 21/00072 428/123
7,537,552 B2 * 5/2009 Dalebout ..... A63B 21/00072 482/121
7,740,563 B2 * 6/2010 Dalebout ..... A63B 21/00072 482/52
8,647,239 B1 * 2/2014 Sokolovas ..... A63B 69/10 482/55
2002/0193213 A1 * 12/2002 Batca ..... A63B 21/0628 482/92
2004/0058788 A1 3/2004 Thompson
2005/0032614 A1 * 2/2005 Keiser ..... A63B 21/4029 482/142
2005/0143230 A1 * 6/2005 Dalebout ..... A63B 21/00072 482/121
2005/0148445 A1 * 7/2005 Carle ..... A63B 21/0615 482/97
2005/0272577 A1 * 12/2005 Olson ..... A63B 21/00072 482/123
2006/0035768 A1 * 2/2006 Kowallis ..... A63B 21/00072 482/123
2008/0020912 A1 * 1/2008 Dalebout ..... A63B 21/026 482/129
2009/0098986 A1 * 4/2009 Quinn ..... A63B 23/0355 482/100
2009/0163323 A1 * 6/2009 Bocchicchio ..... A63B 21/068 482/8
2010/0216610 A1 * 8/2010 Gedeon-Janvier ... A63B 21/072 482/94
2011/0028283 A1 2/2011 Webber et al.
2012/0238418 A1 9/2012 Reyes
2012/0277070 A1 11/2012 Sienna et al.
2013/0190143 A1 * 7/2013 Greenhill ..... A63B 21/0611 482/104
2013/0274075 A1 * 10/2013 Habing ..... A63B 21/062 482/102
2014/0128230 A1 * 5/2014 Burcham ..... A63B 21/00185 482/123
2016/0175639 A1 * 6/2016 Thomson ..... A63B 21/068 482/93

OTHER PUBLICATIONS

International Search Report dated Oct. 17, 2014 from International Patent Application No. PCT/IB2014/061721 filed May 26, 2014.

* cited by examiner

GYMNASTIC MACHINE

CROSS REFERENCE TO RELATED APPLICATIONS

This application is a national stage of International Patent Application No. PCT/IB2014/061721, filed on May 26, 2014 which claims priority to Italian Patent Application No. MO2013A000152, filed on May 28, 2013, the disclosures of which are hereby incorporated entirely herein by reference.

TECHNICAL FIELD

The present invention relates to a gymnastic machine.

BACKGROUND ART

Several types of gymnastic machines are known in the field of exercise equipment.

Such machines generally have a bearing frame that defines a seat adapted to support the user's weight and a loading unit to perform a gymnastic exercise by means of which can be selected the intensity of the exercise itself.

One of the gymnastic machines par excellence, which is part of the basic equipment with which any gym is equipped, is the so-called "flat bench".

The frame of this machine defines a support area for the user's back that is arranged substantially horizontally, while the loading unit, consisting of a barbell on which can be positioned discs of predefined weight, is arranged above the support area.

The support area thus defined is therefore able to support the full user's weight during the performance of the exercise, which consists in lifting the above mentioned barbell.

An alternative to the flat bench is the so-called "slant bench", which differs from the first in the inclination of the support area.

More in detail, the frame of the slant bench has a back support area which is inclined with respect to the horizon and a seat adapted to support the user's weight.

These machines of known type do however have some drawbacks.

They in fact do not guarantee the correct performance of the gymnastic exercise by the user and in particular they do not ensure that he/she maintains the correct posture during the performance of the exercise itself.

This is due to the fact that during the performance of the exercise, and especially in the phase of greater intensity, the user tends to arch his/her back to define a kind of bridge.

Not only does this behavior jeopardize the successful performance of the exercise, but it may even be harmful to the user as far as it involves an overload for the skeletal apparatus and/or articulations and/or tendon apparatus.

It follows therefore that both flat and slant benches in use to date in most gyms, if not properly used, can be inadequate for proper muscle workout and can even cause disease of the skeletal apparatus, of muscle groups other than those worked out and of tendon apparatus.

Furthermore, these machines of known type are not very easy to use since, not being provided with adequate safety means for accident prevention, they necessarily require the presence of another user ready to intervene in case of need, and particularly in the case of very intensive exercises.

Last but not least, these machines do not ensure that the exercise is performed "symmetrically", i.e. allowing the left and right sides of the user's body to work homogenously.

DESCRIPTION OF THE INVENTION

The main aim of the present invention is to provide a gymnastic machine that ensures the correct performance of the gymnastic exercise it is intended to and at the same time ensures the maintenance of the most suitable posture for the exercise itself.

Within this aim, one object of the machine according to the present invention is therefore to obtain an efficient workout of the muscle group involved in the gymnastic exercise without at the same time damaging the user's skeletal apparatus or articulations.

Another object of the present invention is to ensure the user's safety even during high workload exercises and without requiring the presence of a second user.

Not the last object of the present invention is to provide a machine that allows to work out the muscle groups involved in the gymnastic exercise in a symmetrical manner.

Another object of the present invention is to provide a gymnastic machine that allows to overcome the mentioned drawbacks of the prior art in the ambit of a simple, rational, easy and effective to use as well as low cost solution.

The above mentioned objects are achieved by the present gymnastic machine according to claim 1.

BRIEF DESCRIPTION OF THE DRAWINGS

Other characteristics and advantages of the present invention will become more evident from the description of a preferred, but not exclusive, embodiment of a gymnastic machine, illustrated by way of an indicative, but not limitative example in the accompanying drawings wherein.

EMBODIMENTS OF THE INVENTION

Figure 1:
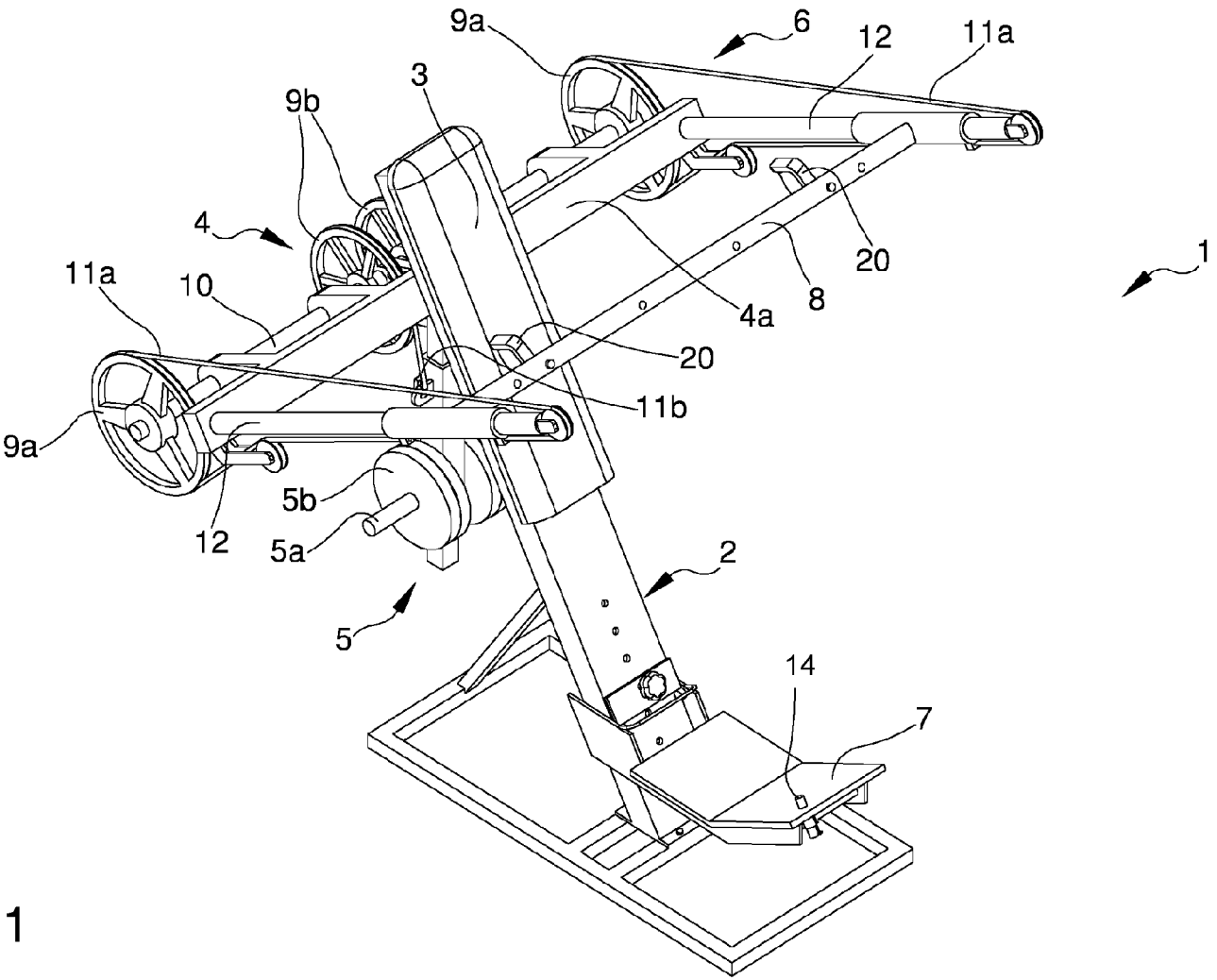
FIG. 1 is a first axonometric view of a gymnastic machine according to the invention.
Figure 2:
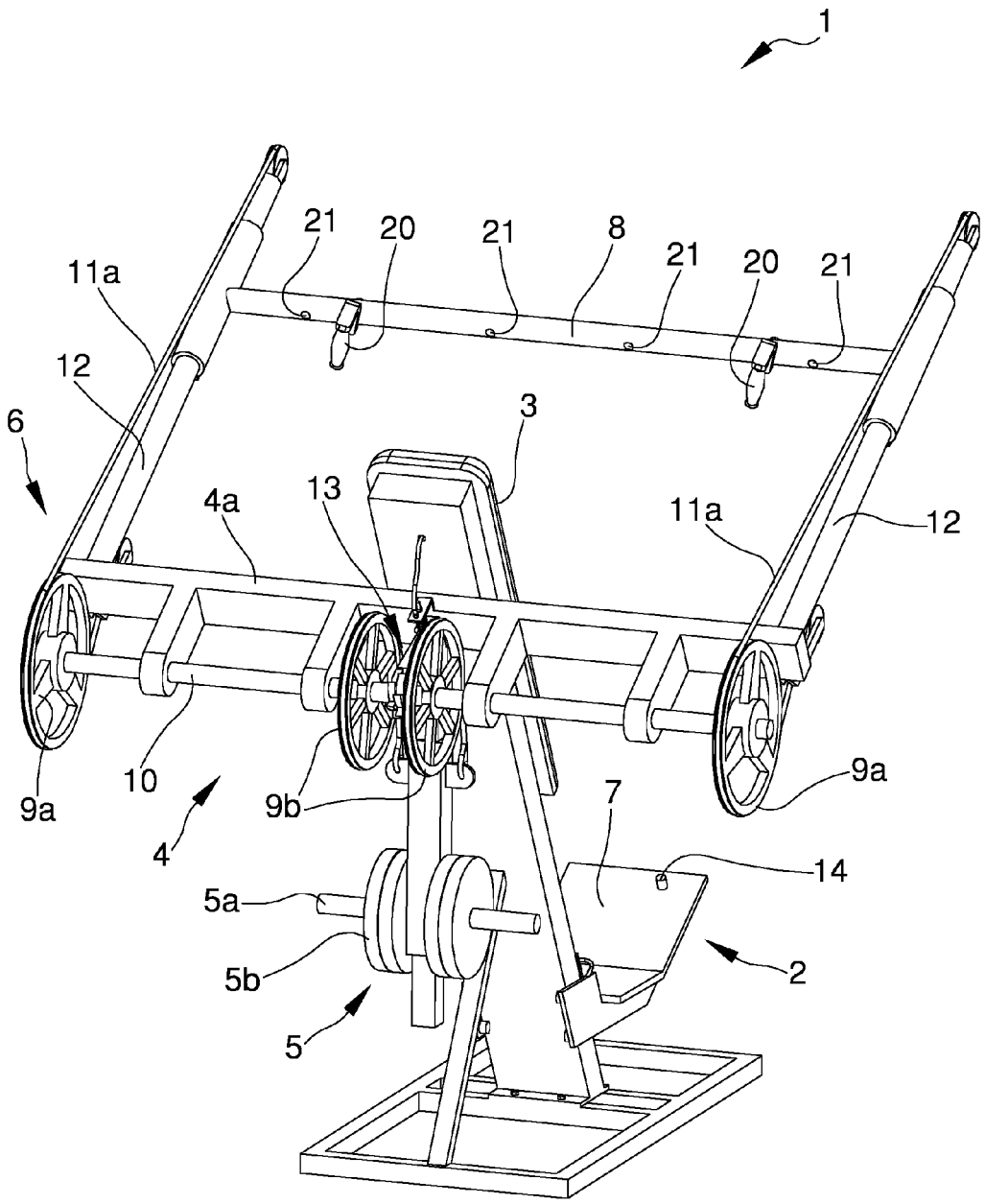
FIG. 2 is a second axonometric view of the machine of FIG. 1.
Figure 3:
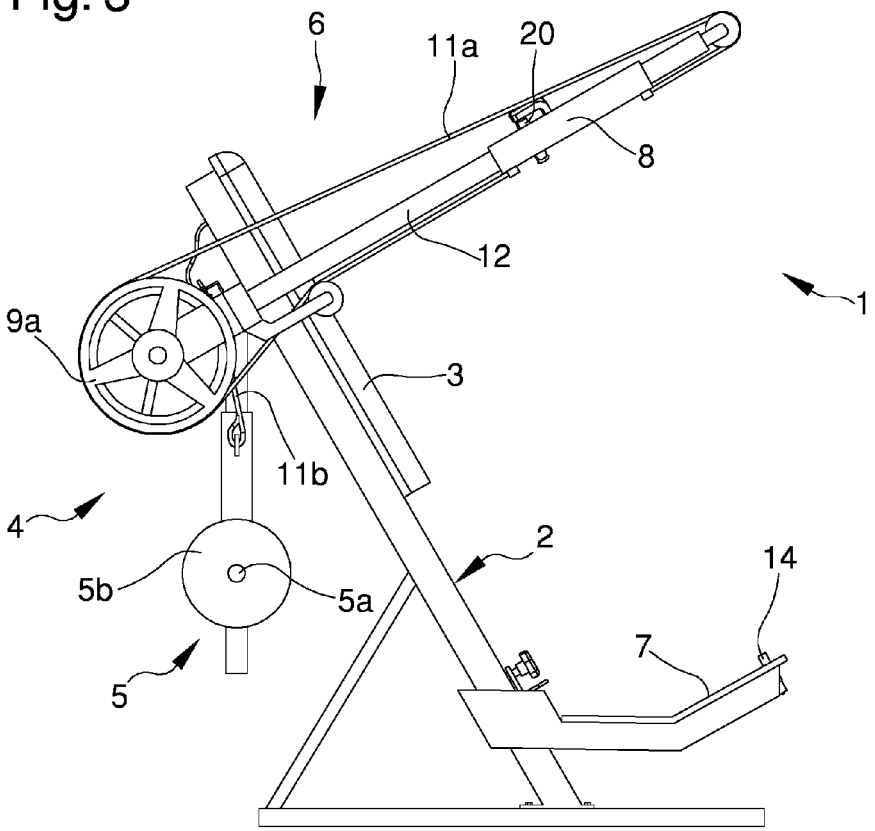
FIG. 3 is a side elevation view of the machine of FIG. 1.
Figure 4:
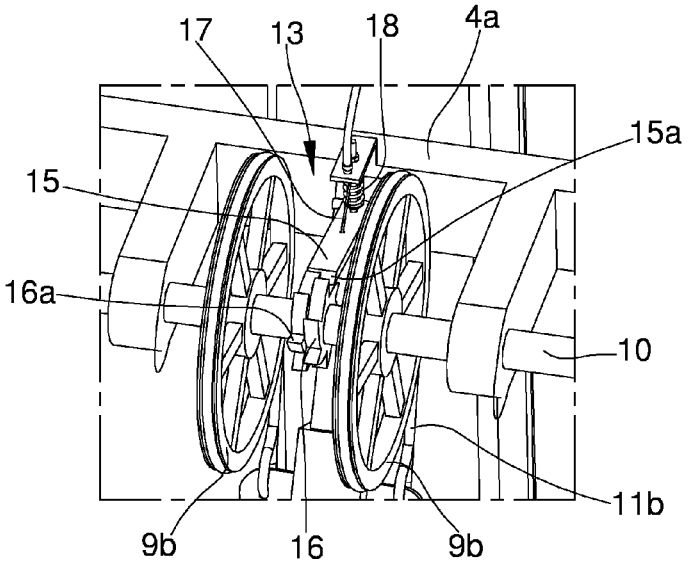
FIG. 4 is an enlargement of the detail of the safety means of the machine of FIG. 1.
Figure 6:
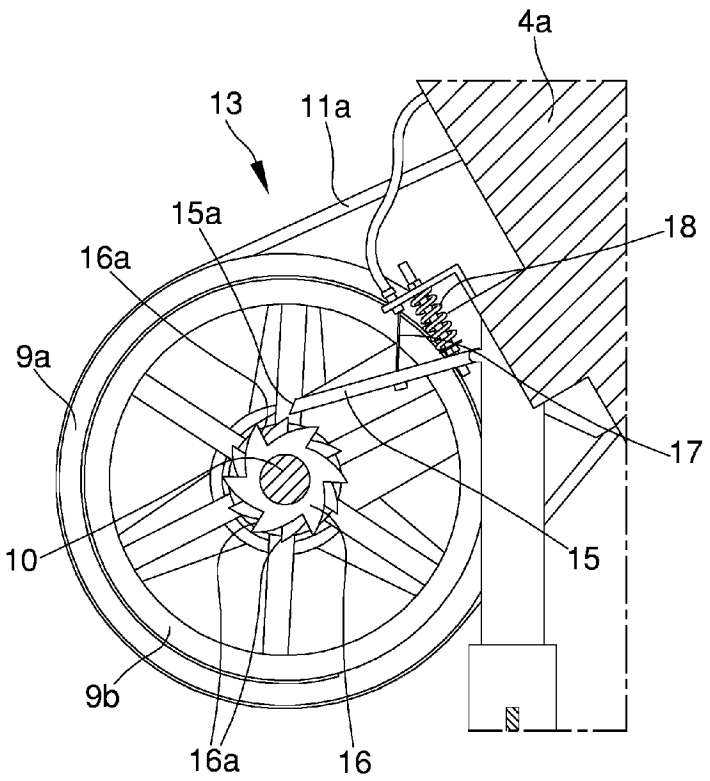
FIG. 6 is a side view of the detail of FIG. 4 with the stop member in the engagement position.
Figure 5:
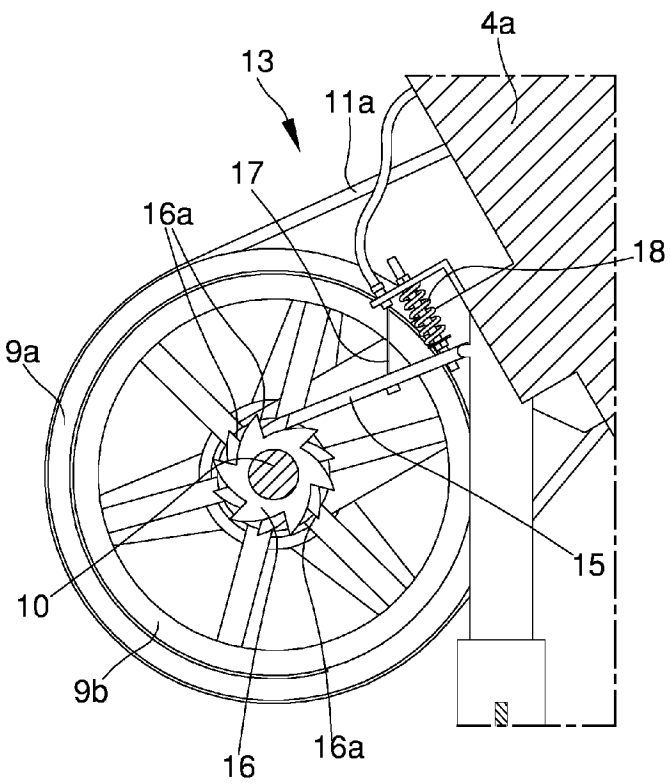
FIG. 5 is a side view of the detail of FIG. 4 with the stop member in the release position.

With particular reference to such figures, globally indicated by reference number 1 is a gymnastic machine.

The machine 1 comprises a frame 2 defining at least a support area 3 for the back of a user, and comprises at least a work unit 4 associated with the frame 2.

The work unit 4 has a loading unit 5 for the execution of a gymnastic exercise and movement means 6 for moving the loading unit 5.

More particularly, the loading unit 5 is the type of one or more support elements 5*a* on which the loading elements 5*b* with a predefined weight can be positioned in a removable manner in order to adjust the workload of the exercise.

The support area 3 is inclined with respect to the vertical and the frame 2 comprises at least a platform 7 for the support of the user's feet which is also inclined with respect to the vertical, where the support area 3 and the platform 7 are mutually convergent downwards. The support area 3 and the platform 7 are therefore inclined on the opposite side with respect to the vertical.

The machine 1 is without a seat, therefore the weight of the user, who holds himself/herself upright, is supported partly by the support area 3 and partly by the platform 7.

This conformation of the machine 1 allows to define a convenient position for the execution of the gymnastic exercise and avoids, since the user's weight rests at least partly on the platform 7 and his/her torso is inclined with respect to the vertical, the user himself/herself can take a wrong posture even in the phase of maximum exertion.

Suitably, the platform 7 is movable in translation with respect to the support area 3, so as to adapt the machine 1 to the user's height. It is easy to understand to the technician of the sector that the platform 7 can move with respect to the support area 3 in a continuous or discrete manner, in the latter case being provided a plurality of predefined positions.

Advantageously, the support area 3 is inclined with respect to the vertical by an angle between 20° and 40° and preferably equal to about 30°.

Similarly, the platform 7 is inclined with respect to the vertical by an angle between 50° and 70° and preferably equal to 60°.

Suitably, the inclination with respect to the vertical of the support area 3 and of the platform 7 is such that their mutual inclination is substantially equal to 90°.

Among the various possible mutual inclinations, this is the one which allows to maximize the efficiency of the exercise performed while at the same time maintaining the ideal posture.

The work unit 4 comprises at least a bearing element 4*a* associated with the frame 2 and supporting the movement means 6 and the loading unit 5.

The bearing element 4*a* may be associated in a removable manner with the frame 2, so as to allow the interchangeability of the work unit 4, in this case, mutual locking means being provided. Alternatively the bearing element 4*a* may be made integrally with the frame itself.

In use the bearing element 4*a* is in any case integral to the frame 2.

The movement means 6 comprise at least a grip element 8 which can be gripped by the user, connected mobile to the bearing element 4*a* and connected in a kinematic manner (where by this term is meant that the shift of one causes the other to shift) to the loading unit 5. The shift of the grip element 8 then causes the loading unit 5 to shift.

The movement means 6 also comprise at least a pulley 9*a*, 9*b*, keyed on a shaft 10 supported in rotation by the bearing element 4*a*, placed between the grip element 8 and the loading unit 5 and connected in a kinematic manner to them by means of at least a flexible element 11*a*, 11*b*. The pulley 9*a*, 9*b* is therefore driven in rotation around a respective axis by the movement of the grip element 8 and, as a result of its rotation, causes in turn the loading unit 5 to shift.

Preferably, the bearing element 4*a* defines at least a pair of guide elements 12 which extend laterally with respect to the support area 3, on opposite sides of the same, and with which the grip element 8, e.g. consisting of a bar which can be gripped by the user, is associated movable in translation.

In the embodiment shown in the figures, the machine 1 also comprises two handles 20 associated with the grip element 8.

Preferably, the handles 20 are associated in a removable manner with the grip element 8, which has a plurality of predefined fastening areas 21. More particularly, the grip element 8 has a plurality of seats 21 wherein the handles 20 can be inserted in a removable manner by means of a relative pin (not shown in the figures).

Suitably, the handles 20 are also associated mobile in rotation with the grip element 8.

By moving the handles 20 along the grip element 8 and/or by varying their angular direction with respect to the same, different muscle groups can be worked out.

Alternative embodiments cannot be ruled out wherein the machine 1 has two grip elements which can be gripped by the user and released from one another. The grip element 8 is in turn connected, by means of a first flexible element 11*a*, to at least a first pulley 9*a* which transfers the motion to at least a second pulley 9*b* through the shaft 10 on which the pulleys themselves are keyed. The second pulley 9*b* is in turn connected to the loading unit 5 by means of a second flexible element 11*b*.

In the preferred, but not exclusive, embodiment shown in the figures, the movement means 6 comprise two first pulleys 9*a* arranged along the extension of the guide elements 12 and two second pulleys 9*b* positioned at the rear of the support area 3.

In an alternative embodiment, not shown in the illustrations, the guide elements 12 are supported in rotation with respect to the frame 2 around a substantially horizontal axis. This allows to vary the inclination of the guide elements 12 with respect to the support area 3 to vary the direction of thrust applied by the user and, consequently, the muscle group involved in the exercise.

According to the invention, the machine 1 comprises safety means 13 operable to lock the shaft 10 in a plurality of predefined positions.

More in detail, the safety means 13 comprise at least an actuation element 14 connected to a stop member 15 adapted to cooperate with an abutment element 16 rigidly associated with the shaft 10 and having a plurality of abutment surfaces 16*a* arranged in succession. The actuation element 14 is operable to move the stop member 15 from an engagement position, wherein it is adapted to cooperate with one of the abutment surfaces 16*a* to prevent the shaft 10 from rotating, and a release position, wherein it is released from the abutment element 16 to allow the rotation of the shaft itself.

Preferably, the stop member 15 in rest configuration is in the engagement position.

In the embodiment shown in the illustrations, the actuation element 14 is connected to the stop member 15 by means of an inextensible cable 17 and elastic means 18 are provided adapted to press the stop member itself in the engagement position. Due to the operation of the actuation means 14, the stop member 15 is therefore brought to the release position in contrast to the elastic means 18.

More particularly, the stop member 15 has a stop surface 15*a* adapted to cooperate, in the engagement position, with a relative abutment surface 16*a*.

The stop surface 15*a* and the abutment surfaces 16*a* are shaped so as to counteract the shift of the stop member 15 from the engagement position to the release position. This is to prevent the grip element 8 from moving towards the user as a result of the weight of the loading unit 5 in the event of the user having operated the actuation element 14 without having actually gripped the grip element 8. In this way the stop member 15 achieves the release position only after the simultaneous operation of the actuation element 14 and shift of the grip element 8 by the user, the latter causing the shaft 10 to rotate and the consequent spacing away of the abutment surface 16*a* from the stop surface 15*a* with which it is in contact.

In the preferred embodiment shown in the illustrations, in the release position the stop member 15 is lifted with respect to the engagement position, wherein the abutment surfaces 16*a* are arranged on top of the stop surface 15*a* with which they are in contact.

Preferably, the abutment element 16 is composed of at least a wheel with oblique teeth keyed onto the shaft 10 to define a ratchet gear with the stop member 15 (such so as to allow, in the engagement position of the stop member, the rotation of the wheel itself in one direction but not in the opposite direction). In the embodiment shown in the illustrations, the abutment element 16 comprises two wheels with oblique teeth keyed onto the shaft 10 and angularly staggered to one another, so as to double (with respect to the case of a single wheel) the number of predefined locking positions.

Advantageously, the actuation element 14 is arranged in correspondence of said platform and can be easily operated by the user.

The operation of the present invention is as follows.

The user initially selects the workload, by adding or removing the loading elements 5*b* to/from the support elements 5*a*, and the desired position of the platform 7 with respect to the support area 3 depending on his/her height.

The user puts his/her back in contact against the support area 3 and with the feet on the platform 7.

To begin with the exercise, the user presses the actuation element 14 with a foot, to bring the stop member 15 in its release position. As mentioned above, the operation of the actuation element 14 does not automatically unlock the shaft 10 and release the grip element 8 in the direction of moving close to the user, since the abutment element 16 remains engaged with the stop member 15 until the user does not operate the grip element itself, so as to reciprocally move the abutment surface 16*a* away from the stop surface 15*a*.

At this point the user is free to perform the exercise by moving the grip element 8.

During the exercise, the user keeps pressed the actuation element 14 to allow the free translation of the grip element 8 in both directions.

When the user reaches the condition of maximum exertion and is no longer able to lift the loading unit 5, he/she releases the actuation element 14 so as to operate the stop member 15 which, coming back in its engagement position, cooperates with the first tooth available of the two wheels 16 and interrupts the descent of the grip element 8.

The high number of abutment surfaces 16*a* defined by the above mentioned abutment element 16 greatly reduces the stroke of the grip element 8 to reach its locking position.

It has in fact been ascertained how the described invention achieves the proposed objects and, in particular, the fact is underlined that the gymnastic machine according to the invention allows the user to maintain the correct posture during the entire exercise.

This is due in particular to the fact that the user, to perform the exercise, should be standing, and not sitting like in the machines of known type, and at the same time a part of his/her weight is supported by the back support area due to the inclination of the same with respect to the vertical.

A further advantage of the machine according to the invention is to ensure the user's safety during all phases of the exercise.

More in detail, the safety means forming the subject of the present invention allow the user to lock the descent of the grip element at any time and without the aid of other people. This allows to perform any exercise, even under heavy workloads, in maximum safety conditions.

The invention claimed is:

1. A gymnastic machine comprising:

a frame defining at least a support area for a back of a user the support area inclined with respect to a vertical axis;

at least a platform for supporting the user's feet, the platform inclined with respect to the vertical axis, where said support area and said platform are inclined on opposite sides with respect to the vertical axis and are mutually convergent downwards;

at least a work unit associated with said frame and having a loading unit for the execution of a gymnastic exercise and movement means for moving said loading unit, where said work unit comprises a bearing element associated with said frame and said movement means comprise at least a grip element which can be gripped by the user, connected mobile to said bearing element and connected in a kinematic manner to said loading unit, wherein shifting said grip element causes said loading unit to shift, wherein said machine is without a seat, said platform being adapted to support at least partly the weight of the user, the platform configured to hold the user upright, and wherein said movement means comprise at least a pulley placed between said grip element and said loading unit and connected in a kinematic manner to the loading unit by at least a flexible element, said pulley being connected on a shaft supported in rotation by said bearing element, and wherein said machine comprises safety means which can be operated to lock said shaft in a plurality of predefined angular positions, and wherein said safety means comprise at least an actuation element operable by the user and connected to a stop member adapted to cooperate with an abutment element integrally coupled with said shaft and having a plurality of abutment surfaces arranged in succession, said actuation element being operable to move said stop member from an engagement position, wherein said stop member is adapted to cooperate with one of said abutment surfaces to prevent said shaft from rotating, to a release position, wherein said stop member is released from said abutment element to allow the rotation of said shaft.

2. The machine according to claim 1, wherein said stop member has a stop surface adapted to cooperate with said abutment surfaces and in that said stop surface and said abutment surfaces are shaped so as to counteract shifting of the stop member from the engagement position to the release position.

3. The machine according to claim 2, wherein in the release position said stop member is lifted with respect to the engagement position and in that said abutment surfaces are arranged on top of said stop surface in the engagement position itself of the stop member.

4. The machine according to claim 1, wherein said actuation element is arranged in correspondence of said platform.

5. The machine according to claim 1, wherein said support area is inclined with respect to the vertical axis by an angle between 20° and 40°.

6. The machine according to claim 1, wherein said platform is inclined with respect to the vertical axis by an angle between 50° and 70°.

7. The machine according to claim 1, wherein said support area and said platform are inclined with respect to one another by an angle substantially equal to 90°.

8. The machine according to claim 1, wherein said bearing element comprises at least a pair of guide elements which extend laterally to said support area, on opposite sides of the support area, and which support in translation said at least one grip element.

9. The machine according to claim 8, wherein said guide elements are supported mobile in rotation around a substantially horizontal axis with respect to said frame.

10. The machine according to claim 1, wherein said bearing element is removable with said frame.

11. The machine according to claim 1, further comprising at least two handles coupled with said grip element and configured to be gripped by the user.

12. The machine according to claim 11, wherein said handles are removably coupled with said grip element, the grip element having a plurality of predefined fastening areas of said handles.

13. The machine according to claim 11, wherein said handles are coupled in rotation with said grip element.

* * * * *